US008680414B2

(12) United States Patent
Staffas et al.

(10) Patent No.: US 8,680,414 B2
(45) Date of Patent: Mar. 25, 2014

(54) SPRING OPERATED SWITCH ACTUATOR WITH DAMPER FOR AN ELECTRICAL SWITCHING APPARATUS

(75) Inventors: Daniel Staffas, Ludvika (SE); Mats Holman, Ludvika (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 13/461,975

(22) Filed: May 2, 2012

(65) Prior Publication Data

US 2012/0228102 A1 Sep. 13, 2012

Related U.S. Application Data

(63) Continuation of application No. PCT/EP2010/066391, filed on Oct. 28, 2010.

(30) Foreign Application Priority Data

Nov. 3, 2009 (EP) ..... 09174926

(51) Int. Cl.
*H01H 5/00* (2006.01)

(52) U.S. Cl.
USPC ..... 200/400; 335/171

(58) Field of Classification Search
USPC ..... 200/329, 400; 335/171
IPC ..... H01H 3/30,3/3042, 3/60
See application file for complete search history.

(56) References Cited

U.S. PATENT DOCUMENTS

| | | | | |
|---|---|---|---|---|
| 3,158,714 | A | 11/1964 | Craig | |
| 4,678,877 | A | 7/1987 | Nicoloso | |
| 5,280,258 | A | 1/1994 | Opperthauser | |
| 5,571,255 | A | 11/1996 | Baginski et al. | |
| 6,444,934 | B1 | 9/2002 | Imura et al. | |
| 6,667,452 | B2 | 12/2003 | Spiegel | |
| 6,917,006 | B2 * | 7/2005 | Bachofen | 200/400 |
| 7,772,513 | B2 * | 8/2010 | Ohda et al. | 200/400 |
| 8,338,732 | B2 * | 12/2012 | Staffas et al. | 200/400 |
| 2012/0228103 | A1 * | 9/2012 | Staffas et al. | 200/329 |

FOREIGN PATENT DOCUMENTS

DE 102004061281 A1 6/2006

OTHER PUBLICATIONS

European Search Report; Application No. EP 09 17 4926; Issued: Mar. 18, 2010; Mailing Date: Mar. 31, 2010; 5 pages.
International Search Report & Written Opinion of the International Searching Authority; Application No. PCT/EP2010/066391; Issued: Jan. 28, 2011; Mailing Date: Feb. 7, 2011; 8 pages.

* cited by examiner

*Primary Examiner* — Vanessa Girardi
(74) *Attorney, Agent, or Firm* — St. Onge Steward Johnston & Reens LLC

(57) ABSTRACT

A spring operated actuator for an electrical switching apparatus. It includes an opening spring, a closing spring and a damper for the closing. The damper is a rotary air damper with components that rotate relative to each other and has air as working medium for the dampening.

18 Claims, 9 Drawing Sheets

SPRING OPERATED SWITCH ACTUATOR WITH DAMPER FOR AN ELECTRICAL SWITCHING APPARATUS

CROSS-REFERENCE TO RELATED APPLICATIONS

The present application is a continuation of pending International patent application PCT/EP2010/066391 filed on Oct. 28, 2010 which designates the United States and claims priority from European patent application 09174926.7 filed on Nov. 3, 2009. The content of all prior applications is incorporated herein by reference.

FIELD OF THE INVENTION

The present invention relates to a spring operated actuator for an electrical switching apparatus, the spring operated actuator including an opening spring and a closing spring to provide an opening and a closing movement respectively of the switching apparatus and including a damper connected to the closing spring and arranged to decelerate the closing movement during at least an end portion of the movement.

BACKGROUND OF THE INVENTION

In a power transmission or distribution network, switching apparatuses are incorporated into the network to provide automatic protection in response to abnormal load conditions or to permit opening or closing (switching) of sections of the network. The switching apparatus may therefore be called upon to perform a number of different operations such as interruption of terminal faults or short line faults, interruption of small inductive currents, interruption of capacitive currents, out-of-phase switching or no-load switching, all of which operations are well known to a person skilled in the art.

In switching apparatuses the actual opening or closing operation is carried out by two contacts where normally one is stationary and the other is mobile. The mobile contact is operated by an operating device which comprises an actuator and a mechanism, where said mechanism operatively connects the actuator to the mobile contact.

Actuators of known operating devices for medium and high voltage switches and circuit breakers are of the spring operated, the hydraulic or the electromagnetic type. In the following, operating devices will be described operating a circuit breaker but similar known operating devices may also operate switches.

A spring operated actuator, or spring drive unit as it is also called, generally uses two springs for operating the circuit breaker; an opening spring for opening the circuit breaker and a closing spring for closing the circuit breaker and reloading the opening spring. Instead of just one spring for each one of the opening spring and the closing spring, sometimes a set of springs may be used for each one of the opening spring and the closing spring. For example, such a set of springs may include a small spring arranged inside a larger spring or two springs arranged in parallel, side by side. In the following, it should be understood that when reference is made to the spring of the respective opening spring and the closing spring, such a spring could include a set of springs. Another mechanism converts the motion of the springs into a translation movement of the mobile contact. In its closed position in a network the mobile contact and the stationary contact of the circuit breaker are in contact with each other and the opening spring and the closing spring of the operating device are charged. Upon an opening command the opening spring opens the circuit breaker, separating the contacts. Upon a closing command the closing spring closes the circuit breaker and, at the same time, charges the opening spring. The opening spring is now ready to perform a second opening operation if necessary. When the closing spring has closed the circuit breaker, the electrical motor in the operating device recharges the closing spring. This recharging operation takes several seconds.

Illustrative examples of spring operated actuators for a circuit breaker can be found e.g. in U.S. Pat. No. 4,678,877, U.S. Pat. No. 5,280,258, U.S. Pat. No. 5,571,255, U.S. Pat. No. 6,444,934 and U.S. Pat. No. 6,667,452.

At actuation of the switching apparatus, the moving contact part thereof is brought to a very high speed in order to break the current as fast as possible. At the end part of the movement it is important to decelerate the movement to avoid impact shocks. Therefore actuators of the kind in question normally are equipped with some kind of dampers to slow down the speed of the moving contact at the end of its movement. One damper is provided for the opening and one for the closing. Normally the dampers are linear with a piston operating in a hydraulic cylinder.

Such a damper is space-consuming and requires a plurality of components to be connected to the drive mechanism of the actuator.

With the term "end" related to a helical torsion spring is in this application meant the end of the spring material, i.e. the end in the direction of the spring helix. For the ends in the axial direction the term "axial end" is used.

SUMMARY OF THE INVENTION

The object of the present invention is to overcome drawbacks related to conventional spring operated actuators with regard to the damping of such. In particular the object is to provide a damper for the closing that requires small space and few components and which is reliable and precise.

The object according to the invention is achieved in that a spring operated actuator of the kind initially specified includes the specific features that the closing damper is a rotary air damper with components that rotate relative to each other and has air as a working medium for dampening.

The damper thus operates with components that rotate relative to each other and has air as working medium for the dampening.

By connecting the damper to the closing spring, the damper may act on the closing spring. The damper may act to damp the closing movement.

By constructing the damper as a rotary operating damper it becomes possible to attain a more compact actuator than otherwise. Since the mechanism for transferring the movement to the moving contact part normally includes a rotating part the damper can easily be connected to this rotating part without any linkage system or the like. The number of moving parts necessary for the dampening thereby is relatively low.

The rotary dampening movement also decreases the risk for failure in comparison with a linearly moving damper.

Since the closing spring damper normally has to provide dampening of a relative low amount of kinetic energy per time unit in comparison with the opening damper it is possible to use air as working medium for the dampening, which eliminates the need for sealing as is required in a hydraulic damper.

Providing a rotary air damper for the closing movement leads to an arrangement that is simple, space-saving and reliable.

According to a preferred embodiment the damper includes housing walls enclosing a circular working chamber and further includes a radial end wall and a rotatable radial displacement body within the chamber, which radial wall and displacement body sealingly cooperate with the housing walls, and the housing walls have at least one outlet orifice forming an outlet for air displaced by the displacement body.

This embodiment represents a convenient constructional realisation of the rotary air damper, where the displacement body displaces the air out through the air outlet during the main part of its movement and then, after the displacement body has passed the air outlet, compresses the air between itself and the radial end wall. During the compression stage, the rotation is damped.

According to a further preferred embodiment, the housing walls have at least one inlet orifice forming an inlet for air.

Thereby is avoided that a strong vacuum develops behind the displacement body which severely would disturb the closing operation.

According to a further preferred embodiment, the housing includes a first part having a first side wall and a second part having a second side wall, which parts are rotatable relative each other and connected by a circumferential seal.

Dividing the housing into two parts in this way leads to a simple solution for arranging the relative rotating parts of the damper and for connecting the damper to the other parts of the actuator with which it cooperates.

According to a further preferred embodiment, the radial end wall is attached to the first side wall and the displacement body is attached to the second side wall.

Such a direct attachment of these active dampening components to the end walls provides a direct relation between these components and the other parts of the actuator with which the damper cooperates. Providing the attachment at the side walls normally leads to a more rigid construction than other alternatives.

According to a further preferred embodiment, the first side wall is in force-transmitting connection to a support end of the closing spring and drivingly connected to a charging transmission.

Thereby a simple and direct drive connection is established between on one hand the charging mechanism and the closing spring that is to be charged there from and on the other hand between the charging mechanism and the radial end wall such that a required repositioning of the radial end wall is performed simultaneously as charging of the closing spring.

According to a further preferred embodiment, the second side wall is drivingly connected to an actuation end of the closing spring and to a main shaft arranged to transmit actuation movement to the switching apparatus.

Thereby a corresponding simple and direct connection is established between the displacement body and the closing spring acting on the main shaft such that a reliable damping is transmitted from the displacement body.

According to a further preferred embodiment, the first part of the housing includes a circumferential wall, which has external drive connection means forming a part of the charging transmission.

Preferably the drive connection means is realized in that the circumferential wall on it outside is shaped as a gear wheel arranged to cooperate with a pinion.

The drive connection means for the recharging of the closing spring thereby is integrated with the rotary damper which further contributes to make the actuator compact and reduce the number of required components. The location of the drive connection means on the circumferential of the housing leads to a simple transmission and by the relative large diameter of the housing a high reduction is obtained in this transmission step.

According to a further preferred embodiment, the closing spring has a charged and an uncharged state, whereby in the charged state the displacement body is located close to the radial end wall on one side thereof and is arranged to rotate to a position close to the other side of the radial end wall when the closing spring discharges.

Thereby the complete turn of almost 360° is made use of, which simplifies to attain a pattern of the closing movement as desired, in particular with regards to the extension of the deceleration phase.

According to a further preferred embodiment, the outlet orifice, when the closing spring is in its charged state, is located on the opposite side of the radial end wall with respect to the displacement body at an angular distance from the radial end wall in the range of 10° to 120°, preferably in the range of 30° to 90°.

The position of the outlet orifice determines the moment when the dampening starts. In most applications an adequate starting of the dampening will fall within the specified range, normally within the closer range. The degree of air leakage around the radial end wall and the displacement body will affect where the optimal location is.

According to a further preferred embodiment, the closing spring is a helical torsion spring.

The advantages with a rotary damper will be more accentuated when also the closing spring is acting in the rotational direction as does a torsion spring. The connections between the damper and the closing spring thereby also will be simple. Particularly advantageous is when the opening spring as well is a helical torsion spring.

According to a further preferred embodiment the closing spring is coaxial with the working chamber of the damper.

This further increases the advantages of using a rotary damper since the damper and the closing spring thereby will be well adapted to cooperate. Preferably also the main shaft of the actuator is coaxial with the damper.

According to a further preferred embodiment, the helical torsion spring defines a winding direction and an unwinding direction thereof, whereby the spring is arranged to be charged with mechanical energy in the unwinding direction and to discharge the mechanical energy in the winding direction.

This means that the torsion spring is compressed in the direction of the spiral of the spring when it stores the energy, and the ends of the spring act by pushing in stead of pulling as in a conventional helical torsion spring. The connection of the spring ends to the support and to the drive shaft thereby becomes less complicated in comparison with a mounting under tension in stead of pressure.

Since the spring ends act by a pressure force on the components with which the torsion spring co-operate, the spring end and the component in question are held together by this force without any further connection means, except for possibly some kind of guiding device keeping them laterally in place. This substantially simplifies the mounting in comparison with a torsion spring operating by tension, in which case strong and reliable connection means are required.

Thereby the assembly of the device becomes much simpler, and fewer components is required. Further a potential source of malfunction is eliminated. A device according to the present invention therefore becomes cheaper in manufacture and maintenance and also more reliable.

Preferably, the electrical switching apparatus is a circuit breaker for medium or high voltage.

A circuit breaker is the most important application for the present invention and the advantages of the invention of the invention are particularly useful in the medium and high voltage range.

By medium voltage is conventionally meant a voltage level in the range of 1-72 kV and by high voltage is meant a voltage level above 72 kV, and these expressions have this meaning in the present application.

The invention also relates to an electric switching apparatus that includes a spring operated actuator according to the present invention, in particular to any of the preferred embodiments thereof. Preferably the switching apparatus is a circuit breaker and preferably the switching apparatus is a medium or high voltage switching apparatus.

The invented switching apparatus has corresponding advantages as those of the invented spring operated actuator and the preferred embodiments thereof, which advantages have been described above.

Preferred embodiments of the invention are specified herein. It is to be understood that further preferred embodiments of course can be realized by any possible combination of preferred embodiments mentioned above.

The invention will be further explained through the following detailed description of an illustrative example thereof and with reference to the accompanying drawings.

DETAILED DESCRIPTION OF THE INVENTION

Figure 1:
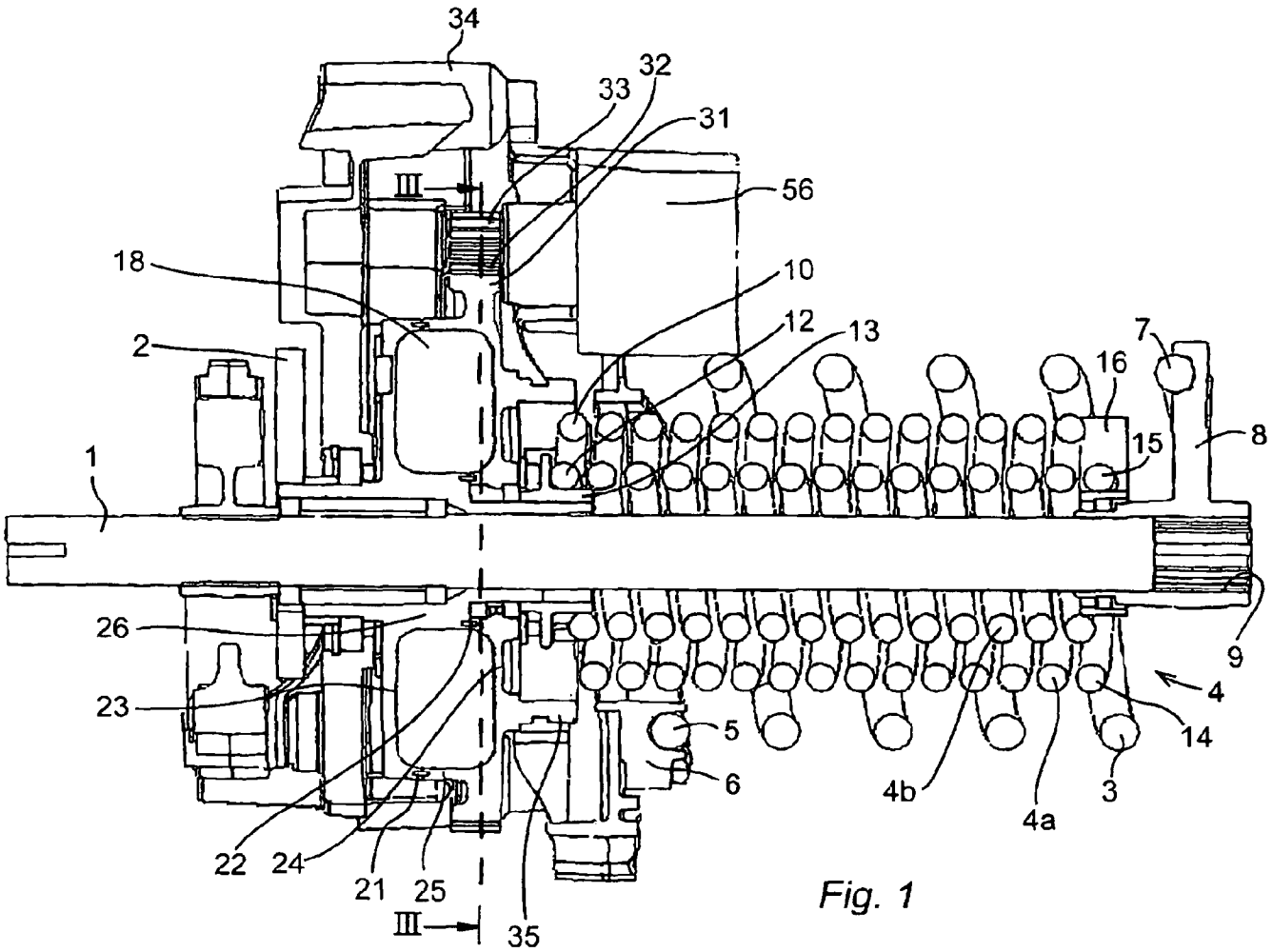
FIG. 1 is an axial section through an example of a spring operated actuator according to the invention.

FIG. 1 is an axial section through the actuator of a circuit breaker. The actuator has a main shaft 1 and a cam disc 2. The cam disc acts on the transmission rod (not shown) for switching the circuit breaker. The transmission from the cam disc to the circuit breaker and the circuit breaker as such can be of a conventional kind and need no further explanation.

The main shaft is operated by an opening spring 3 and a closing spring 4. Both the springs are helical torsion springs and are coaxial with the main shaft. The opening spring 3 is located radially outside the closing spring 4 and thus has an internal diameter exceeding the external diameter of the closing spring 4.

The opening spring 3 is squeezed between two end fittings, a supporting end fitting 6 at the supported end 5 of the spring and an actuating end fitting 8 at its actuating end 7. The opening spring 3 thus in its charged state is compressed in the direction of its helix, or otherwise expressed the charged opening spring is pressed in its unwinding direction. As a consequence the actuating end 7 is acting with a pushing force on the actuating end fitting 8, which is connected through splines 9 to the main shaft 1.

The closing spring 4 consists of two units, a radially outer unit 4*a* and a radially inner unit 4*b*, which both have axes aligned with the axis of the opening spring 3 and with the main shaft 1.

Like the opening spring also the closing spring 4 in its charged state is compressed in the direction of its helix. The outer unit 4*a* of the closing spring has a supported end 10 and a connection end 14, and the inner part has an actuating end 12 and a connection end 15. The supported end 10 is pressed against a supporting end fitting (not shown) which is mounted on a support flange 35, and the actuating end 12 is pressed against an actuating end fitting 13. The connection ends 14, 15 of the two units 4*a*, 4*b* are both pressed against a connection fitting 16, through which the two units are in force transmitting relation to each other.

When the circuit breaker is triggered for an opening action the opening spring 3 pushes its actuation end fitting 8 to rotate and thereby rotate the main shaft 1.

Some 0.3 seconds later the circuit breaker is to be closed. The closing spring 4 thereby is activated such that the actuating end 12 thereof pushes its actuating end fitting 13 to rotate the main shaft 1 in a direction opposite to that of the opening process to move the actuation rod, thereby closing the circuit breaker. When the main shaft 1 rotates in this direction it will also rotate the actuating end fitting 8 of the opening spring 3 in the same direction such that it pushes the actuating end 7 of the opening spring 3 and the opening spring becomes recharged and prepared for a consecutive opening movement should that be required.

When the closing operation is finished the closing spring is recharged in that its supported end 10 is pushed by its supporting end fitting.

At the ends of the opening and closing movements the movements have to be damped in order to avoid impact shocks at the end of the strokes due to excess of energy.

The opening movement is damped by a conventional linearly acting hydraulic damper 17.

The closing movement is damped by a rotary damper 18 having air as working medium. The rotary damper 18 may have components that are rotatable relative to each other. The rotary damper 18 has a toroidal working chamber, that is coaxial with the main shaft 1. The working chamber is formed by a housing having a first side wall 24, a second side wall 23, an outer circumferential wall 25 and an inner circumferential wall 26. The housing is splitted into two parts, a first part 20 and a second part 19. The two parts are rotatable relative to each other and are connected by an outer circumferential seal 21 and an inner circumferential seal 22.

The second part 19 is drivingly connected to the actuating end fitting 13 of the inner unit 4*b* of the closing spring 4 and thus rotates together with the cam disc 2 at closing. The first part 20 on its outside has an axially extending flange 35 on which the supporting end fitting of the outer unit 4*a* of the closing spring 4 is mounted.

Figure 3:
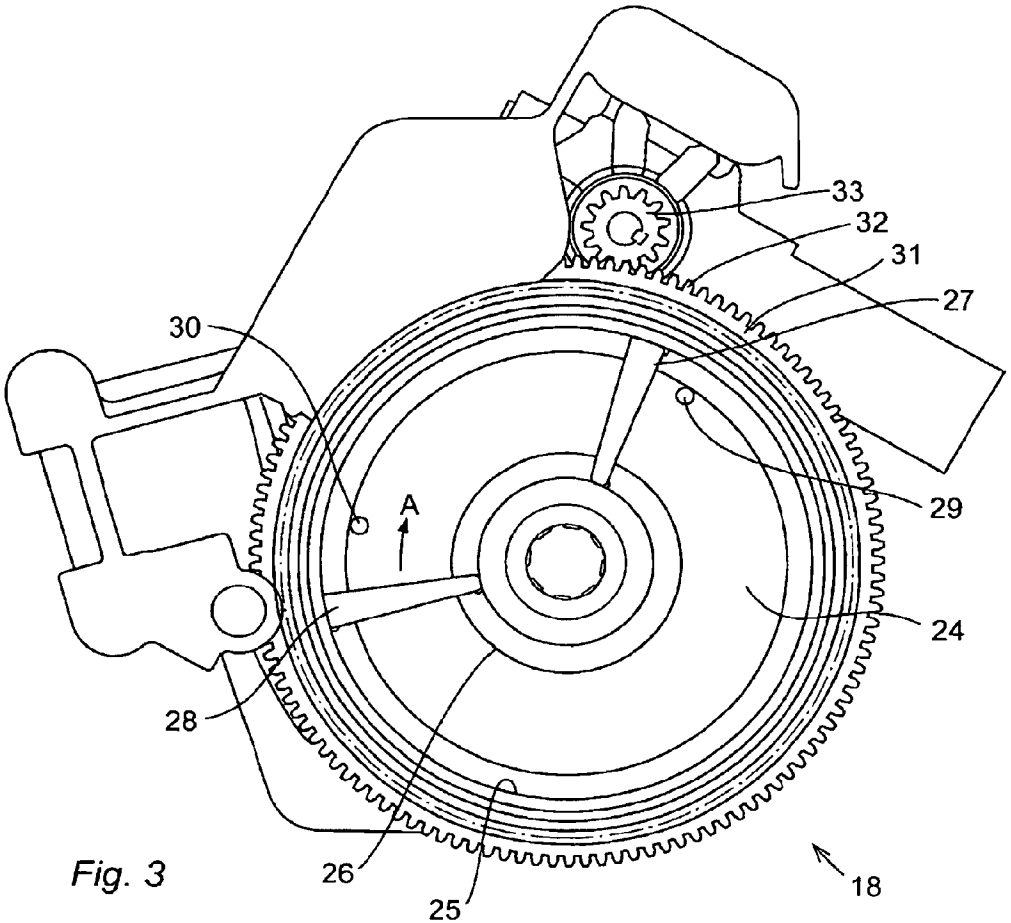
FIG. 3 is a section along line III-III in FIG. 1.

The operation of the closing damper is explained with reference to FIG. 3 which is a radial section through the damper in the direction towards the first part 20. During the closing movement the first part 20 is stationary and the second part 19 (not visible in FIG. 3) is rotating in direction of arrow A, defined as the rotational direction of the damper.

A disc-like body is attached to the first side wall 24, which forms a radial end wall 27. A corresponding disc-like body is attached to the second side wall 23 and forms a displacement body 28. Each of the end wall 27 and the displacement body 28 are sealingly cooperating with the side walls 23, 24 and the circumferential walls 25, 26 of the working chamber.

The first side wall has a first 29 and second 30 orifice there through to act as inlet and outlet respectively for air.

The inlet orifice 29 is located short after the end wall 27 as seen in the rotational direction of the damper. The outlet orifice 30 is located about a right angle ahead of the end wall 27.

When the closing spring is charged and in condition for initiating a closing movement the displacement body 28 is located closed to the end wall 27 on its right side as seen in the figure, i.e. in the area of the inlet orifice 29. The second part 19 of the housing is drivingly connected with the main shaft.

When a closing movement occurs the displacement body 28 will move from its initial position adjacent the end wall 27 since it is connected to the second side wall 23, and rotate in the direction of arrow A until it has made an almost complete turn and reaches the left side of the end wall 27. During its rotation air will be sucked in through the inlet orifice 29. And during the major part of the turn air will be pressed out through the outlet orifice 30.

After the displacement body has passed the outlet orifice 30 air will be trapped between the displacement body 28 and the end wall 27. Further rotation will compress the trapped air. Thereby an increasing counterforce against the rotation develops and some air leakage will occur along the sealing lines between the end wall 27 and the walls of the housing and between the displacement body 28 and the walls. Thereby the damping effect is achieved.

Normally the air leakage around the end wall and the displacement body is sufficient to attain a damping that is properly balanced between overdamping and underdamping. In case the seals are very effective a proper air leakage can be attained by providing a small leakage hole through the end wall 27 or through the displacement body 28.

Figure 4:
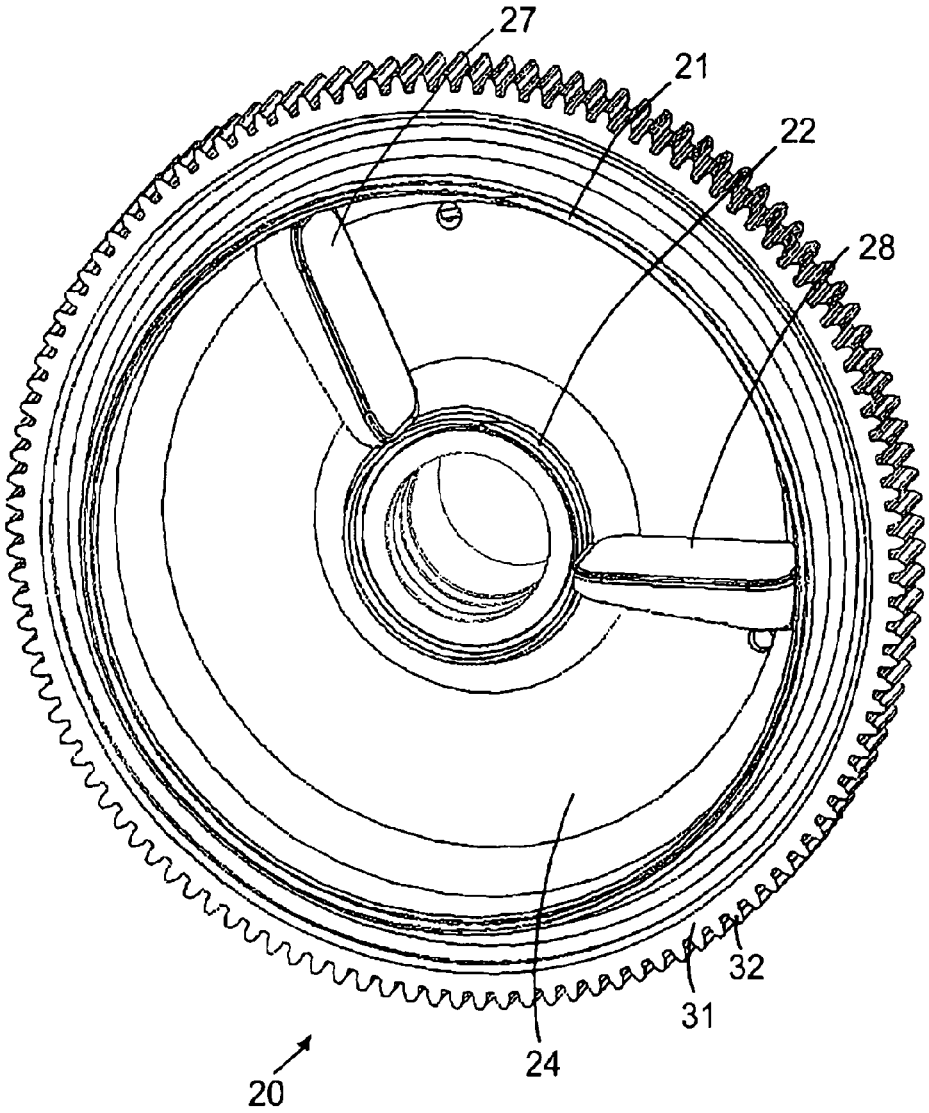
FIG. 4 is a perspective view of a detail of FIG. 3.

FIG. 4 is a perspective view of the first part of the housing of the closing damper.

The mechanism for charging the closing spring 4 is partly integrated with the closing damper 18. The first part 20 of the damper is externally shaped as a gear wheel 31 with external radially projecting teeth 32. The gear wheel 31 cooperates with a pinion 33 driven by an electric motor via a gear box 56. At charging, the pinion 33 drives the first part 20 of the damper 18 in the direction of arrow A (FIG. 3) about one complete turn. The end wall 27 thereby moves to a position immediately to the left of the displacement body 28. The end wall 27 and the displacement body thus will reach a position relative to each other as described above when the closing movement starts.

Figure 2:
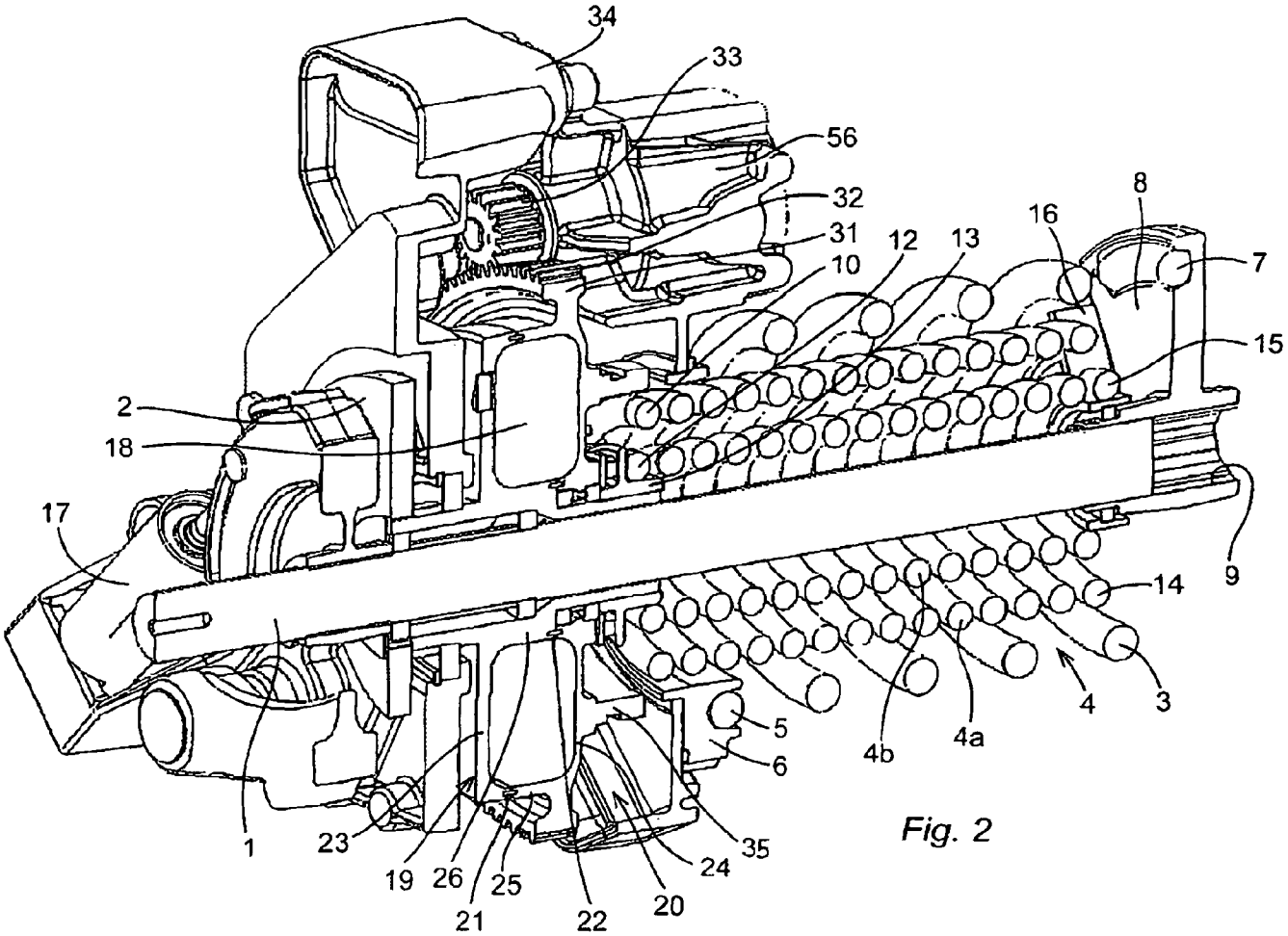
FIG. 2 is a perspective view of the section of FIG. 1.

The first part 20 of the damper 18 is through the flange 35 (FIGS. 1 and 2) drivingly connected to the supporting end fitting 11 of the outer unit 4*a* of the closing spring 4.

When the first part 20 rotates, the supporting end fitting of the outer unit 4*a* of the closing spring will follow its rotation since it is mounted on the axial flange 35 extending rearwards from the first part 20 of the damper 18. Thereby the closing spring is helically compressed to its charged state.

Figure 5:
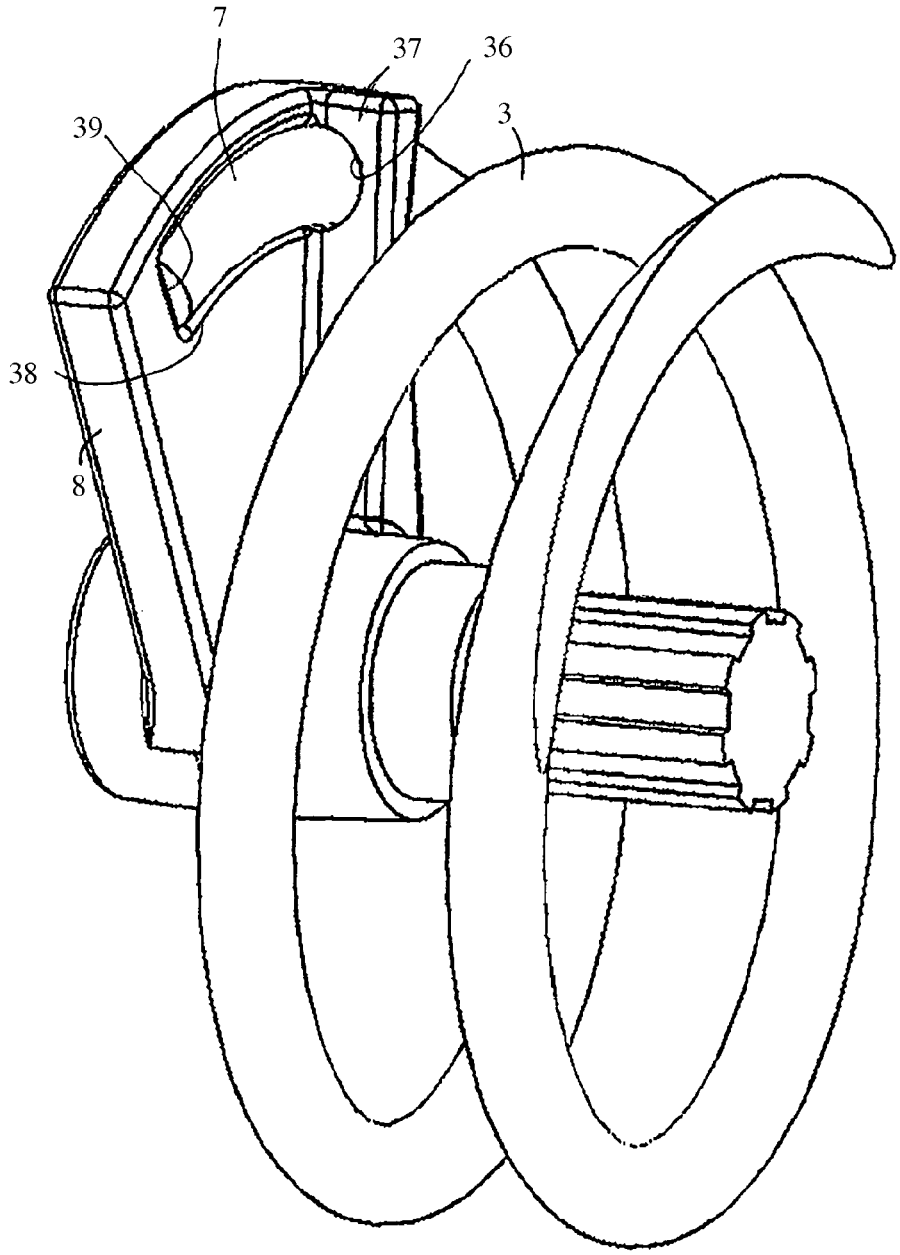
FIG. 5 is a perspective view of a detail of the spring operated actuator of FIG. 1-4.

FIG. 5 is a perspective view of the end fitting 8 of the opening spring 3 as seen from the spring towards the end fitting. The actuating end 7 of the opening spring 3 extends through a hole 36 in a flange 37 forming a part of the end fitting 8. A groove 38 in the end fitting 8 guides the actuating end 7 against an abutment surface 39. The other end fittings may have a similar construction.

Figure 6:
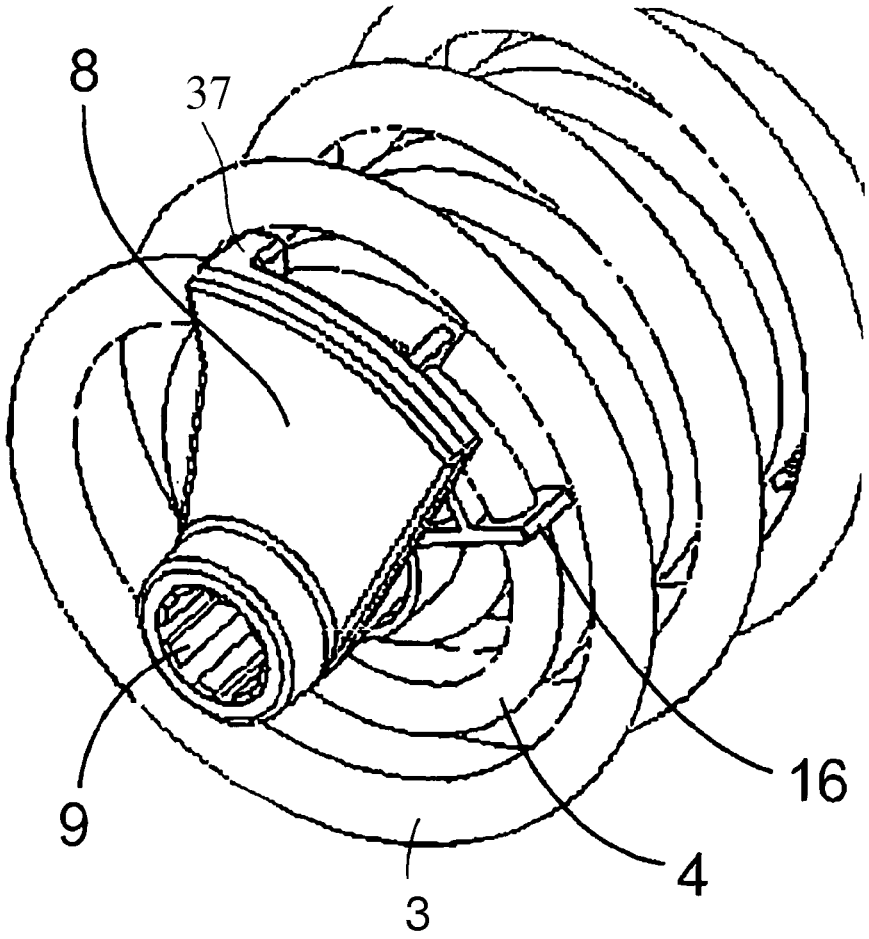
FIG. 6 is a perspective view of the detail in FIG. 5 from another direction.

FIG. 6 illustrates the actuating end fitting 8 of the opening spring 3 from another direction. Also the connection end fitting 16 of the units 4*a* and 4*b* is partly visible there behind.

Figure 7:
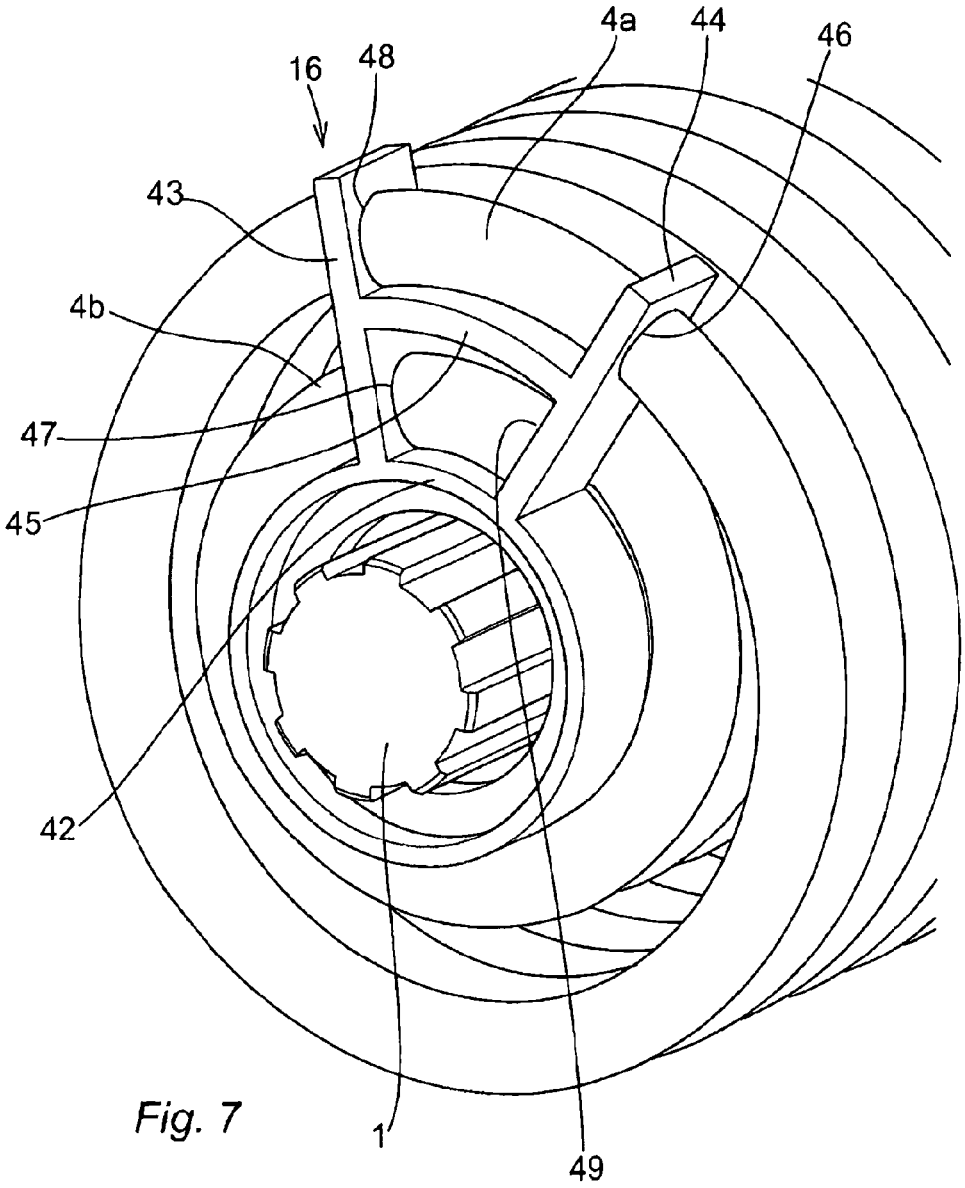
FIG. 7 is a perspective view of a further detail of the spring operated actuator of FIG. 1-6.

FIG. 7 illustrates the connection end fitting 16 more in detail. It consists of an inner ring 42 from which a first 43 and a second 44 abutment flange extend radially outwards at an angular position relative to each other of about 45-60°. At the radial middle of the abutment flanges 43, 44 a circular wall 45 interconnects them, which circular wall is coaxial with the inner ring 42. The first abutment flange 43 has an abutment surface 48 at its radially outer part and a hole 47 through its inner part. Correspondingly the second abutment flange 44 has a hole 46 through its outer part and an abutment surface 49 on its inner part.

The inner closing spring unit 4*b* extends through the hole 47 of the first flange 43, and its end abuts the abutment surface 49 of the second flange 44. Correspondingly the outer closing spring unit 4*a* extends through the hole 46 of the second flange 44, and its end abuts the abutment surface 48 of the first flange 43. A pushing force from the outer closing spring unit 4*a* thereby is transmitted to the inner closing spring unit 4*b*. The end portions of the closing spring units 4*a*, 4*b* are guided against its respective abutment surface 48, 49 by the holes 46, 47, the ring 42 and the circular wall 45. The end portions thereby can be loosely fitted into the connection end fitting 8 and no further attachment means is required.

Figure 8:
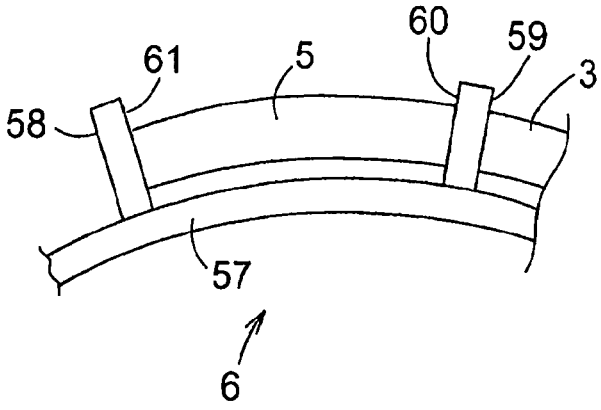
FIG. 8 is a side view of a part of a detail of FIG. 1-4 according to an alternative example.

An alternative construction of the end fittings is illustrated in FIG. 8. In FIG. 8 a part of the supporting end fitting 6 for the opening spring 3 is schematically illustrated. The supported end portion 5 of the opening spring 3 has an end surface against an abutment surface 61 on a radial flange 58 of the end fitting 6. A holding device is formed by a second radial flange 59 and a circumferential part 57 connecting the two flanges 58, 59. The second radial flange 59 has a hole 60 there through and the opening spring extends through this hole 60 such that its end portion 5 is directed towards the abutment surface 61. The other end fittings may have a similar construction.

Figure 9:
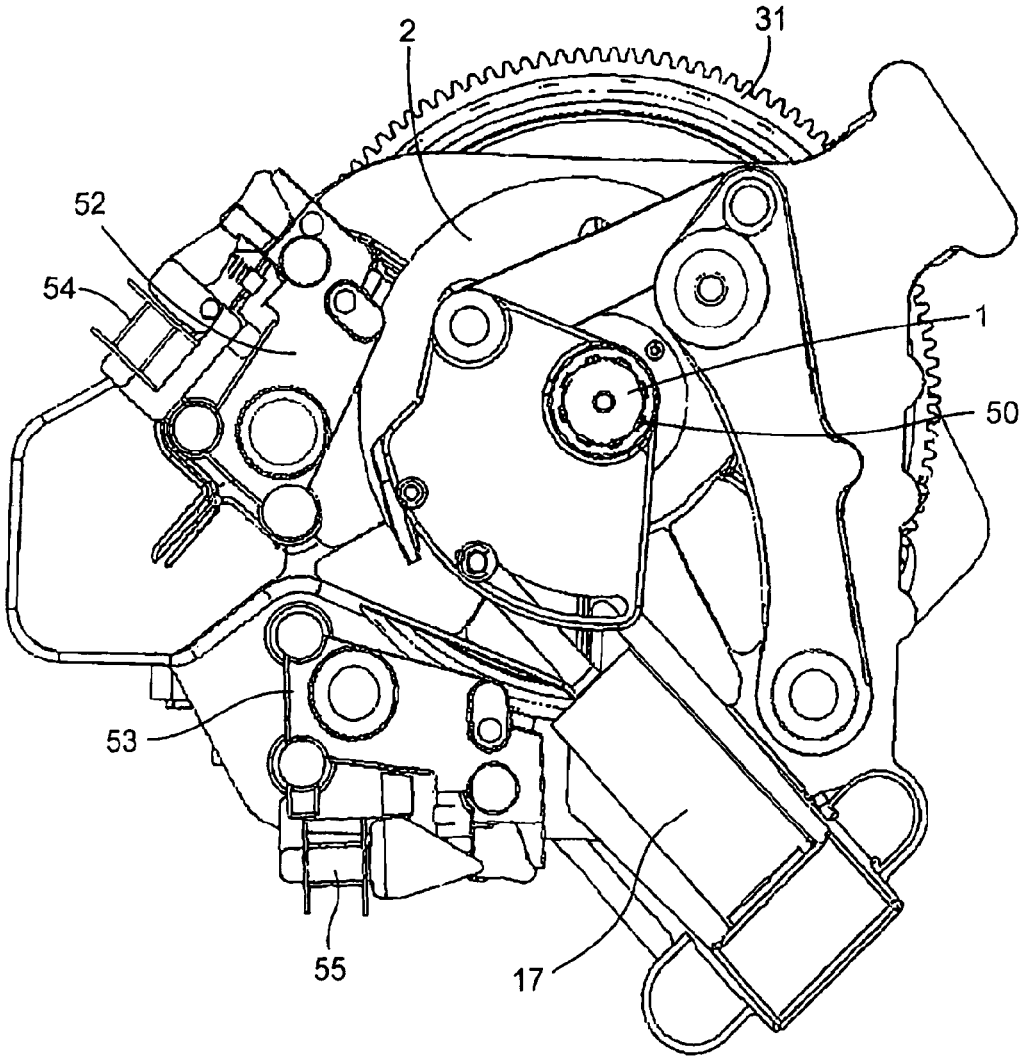
FIG. 9 is an end view of the spring operated actuator as seen from the left of FIG. 1.

FIG. 9 is an end view of the spring operated actuator as seen from the left in FIG. 1. The cam disc 2 is drivingly connected to the main shaft 1 through splines 50. Latch mechanisms 52, 53 with a respective trigging coil 54, 55 control the opening and closing movements of the actuator. In the left part of the figure the oil damper 17 for the opening spring is visible, and to the left a part of the gear wheel 31 for charging the closing spring can be seen.

Figure 10:
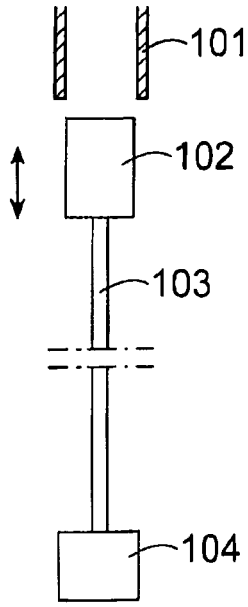
FIG. 10 is a schematic side view of a circuit breaker.

FIG. 10 schematically illustrates a circuit breaker where the movable contact part 102 is brought into and out of contact with the stationary contact part 101 by a rod 103 actuated by a spring operated actuator 104 according to the present invention. For a three phase breaker the actuator 104 can be arranged to simultaneously move the movable contact part 102 of each phase.

What is claimed is:

1. A spring operated actuator for an electrical switching apparatus, the spring operated actuator including:

an opening spring and a closing spring to provide an opening and a closing movement respectively of the switching apparatus; and a damper connected to the closing spring and arranged to decelerate the closing movement during at least an end portion of the closing movement, the damper having housing walls that enclose a circular working chamber and a rotatable radial displacement body disposed within the chamber;

characterized in that the damper is a rotary air damper with components that rotate relative to each other and has air as working medium for dampening.

2. The spring operated actuator according to claim 1 characterized in that the electrical switching apparatus is a circuit breaker for a medium or high voltage.

3. The spring operated actuator according to claim 1 characterized in that the closing spring is a helical torsion spring.

4. The spring operated actuator according to claim 3 characterized in that the closing spring is coaxial with the working chamber of the damper.

5. The spring operated actuator according to claim 3 characterized in that the helical torsion spring defines a winding direction and an unwinding direction thereof, whereby the helical torsion spring is arranged to be charged with mechanical energy in the unwinding direction and to discharge the mechanical energy in the winding direction.

6. The spring operated actuator according to claim 1 characterized in that the damper further includes a radial end wall, the radial end wall and the displacement body sealingly cooperate with the housing walls, wherein the housing walls have at least one outlet orifice forming an outlet for air displaced by the displacement body.

7. The spring operated actuator according to claim 6 characterized in that the closing spring has a charged and an uncharged state, whereby in the charged state the displacement body is located close to the radial end wall on one side thereof and is arranged to rotate to a position close to the other side of the radial end wall when the closing spring discharges.

8. The spring operated actuator according to claim 7 characterized in that when the closing spring is in the charged state, the outlet orifice is located on the opposite side of the radial end wall with respect to the displacement body at an angular distance from the radial end wall in the range of 10° to 120°.

9. The spring operated actuator according to claim 6 characterized in that the housing walls have at least one inlet orifice forming an inlet for air.

10. The spring operated actuator according to claim 9 characterized in that the housing includes a first part having a first side wall and a second part having a second side wall, which parts are rotatable relative each other and connected by a circumferential seal.

11. The spring operated actuator according to claim 10 characterized in that the radial end wall is attached to the first side wall and the displacement body is attached to the second side wall.

12. The spring operated actuator according to claim 11 characterized in that the second side wall is drivingly connected to an actuation end of the closing spring and to a main shaft arranged to transmit actuation movement to the switching apparatus.

13. The spring operated actuator according to claim 11 characterized in that the first side wall is in force-transmitting connection to a supported end of the closing spring and drivingly connected to a charging transmission.

14. The spring operated actuator according to claim 13 characterized in that the first part of the housing includes a circumferential wall, which circumferential wall has external drive connection means forming a part of the charging transmission.

15. An electrical switching apparatus characterized in that the switching apparatus includes:

a spring actuator, the spring actuator including an opening spring and a closing spring to provide an opening and a closing movement respectively of the switching apparatus; and a damper connected to the closing spring and arranged to decelerate the closing movement during at least an end portion of the closing movement, the damper having housing walls that enclose a circular working chamber and a rotatable radial displacement body disposed within the chamber;

characterized in that the damper is a rotary air damper with components that rotate relative to each other and has air as working medium for dampening.

16. The electrical switching apparatus according to claim 15 characterized in that the switching apparatus is a circuit breaker.

17. The electrical switching apparatus according to claim 15 characterized in that the switching apparatus is a medium or high voltage switching apparatus.

18. A spring operated actuator for an electrical switching apparatus, the spring operated actuator including:

an opening spring and a closing spring to provide an opening and a closing movement respectively of the switching apparatus; and a damper connected to the closing spring and arranged to decelerate the closing movement during at least an end portion of the closing movement, the damper having housing walls that enclose a circular working chamber and a rotatable radial displacement body disposed within the chamber;

characterized in that the damper is a rotary air damper with components that rotate relative to each other and has air as working medium for dampening; and characterized in that the damper further includes a radial end wall, the radial end wall and the displacement body sealingly cooperate with the housing walls, wherein the housing walls have at least one outlet orifice forming an outlet for air displaced by the displacement body.

* * * * *